US005961047A

United States Patent [19]

Kleinberger

[11] Patent Number: 5,961,047

[45] Date of Patent: Oct. 5, 1999

[54] LIQUID SPRAYING SYSTEM FOR FINE MISTING AND HUMIDIFICATION

[76] Inventor: Itamar Kleinberger, 4367 Dunmore Rd., Marietta, Ga. 30068

[21] Appl. No.: 09/088,343

[22] Filed: Jun. 1, 1998

Related U.S. Application Data

[60] Provisional application No. 60/049,814, Jun. 17, 1997, and provisional application No. 60/083,603, Apr. 30, 1998.

[51] Int. Cl.[6] ..... B05B 7/04; B05B 1/14

[52] U.S. Cl. ..... 239/124; 239/433; 239/548

[58] Field of Search ..... 239/8, 124, 428.5, 239/433, 434, 548, 551, 556, 557, 562, 566, 567; 261/DIG. 14, 116

[56] References Cited

U.S. PATENT DOCUMENTS

| | | | |
|---|---|---|---|
| 1,020,937 | 3/1912 | Warwick . | |
| 1,441,425 | 1/1923 | Jackson | 261/116 |
| 1,650,739 | 11/1927 | Ridler . | |
| 1,717,181 | 6/1929 | Birdsong et al. | 261/DIG. 14 |
| 1,778,141 | 10/1930 | Birdsong et al. | 261/116 |
| 1,860,600 | 5/1932 | Slaymaker . | |
| 1,863,914 | 6/1932 | Tyler . | |
| 1,926,651 | 9/1933 | Rombach . | |
| 1,951,587 | 3/1934 | Tyler . | |
| 2,036,446 | 4/1936 | Tsutsumi . | |
| 2,039,769 | 5/1936 | Bird . | |
| 2,074,178 | 3/1937 | Greene | 261/DIG. 14 |
| 2,090,326 | 8/1937 | Glattke . | |
| 2,281,458 | 4/1942 | Schadegg | 62/37 |
| 2,584,650 | 2/1952 | Woodruff | 126/113 |
| 2,826,454 | 3/1958 | Coanda . | |
| 3,126,427 | 3/1964 | Broughton | 261/2 |
| 3,130,024 | 4/1964 | Vaughan, Jr. | 55/227 |
| 3,280,887 | 10/1966 | Charuit et al. | 159/13 |
| 3,561,194 | 2/1971 | Baldwin et al. | 55/249 |
| 3,563,472 | 2/1971 | Skaptason | 239/511 |
| 3,990,427 | 11/1976 | Clinebell | 126/113 |
| 4,179,900 | 12/1979 | Corrigan | 62/231 |
| 4,541,473 | 9/1985 | Onoe et al. | 239/557 |
| 4,738,806 | 4/1988 | Noma et al. | 261/81 |
| 4,803,303 | 2/1989 | Edwards et al. | 210/138 |
| 4,914,339 | 4/1990 | Hayman, Jr. et al. | 312/115 |
| 5,193,354 | 3/1993 | Kleinberger et al. | 62/247 |
| 5,203,180 | 4/1993 | Weisbrich | 261/DIG. 14 |
| 5,350,117 | 9/1994 | Kleinberger et al. | 239/428.5 |
| 5,762,661 | 6/1998 | Kleinberger et al. | 261/DIG. 14 |

FOREIGN PATENT DOCUMENTS

| | | |
|---|---|---|
| 3313399 | 10/1984 | Germany . |
| 2119501 | 11/1983 | United Kingdom . |

OTHER PUBLICATIONS

Trouble Free Injection of Fertilizers & Chemicals—Mazzei Injector Corp.

OASIS by OvelSystems, Inc. brochure.

"OASIS" by Ovel–Worldwide Leaders of Automatic Spray Systems brochure.

Air Pump—Aeration Made Simple—Maryland Water Conditioning, Inc.

P. 51 of Water Conditioning Purification Magazine—Mar., 1997.

*Primary Examiner*—Lesley D. Morris

*Attorney, Agent, or Firm*—Womble Carlyle Sandridge & Rice; Louis T. Isaf

[57] ABSTRACT

A liquid spraying system for maintaining a predetermined amount of moisture in an environment, particularly suited for use on produce displayed in a produce display. The system operates in a manner that purposely introduces air into liquid flowing through the system to ultimately spray a fine mist into an environment. The use of a venturi injector in a preferred embodiment allows for the introduction of air into the system while eliminating the need for an added air compressor. The uniform mixture of air and water then flows through a liquid pump, and alternatively an expansion tank, and can be delivered to one or more nozzle assemblies at a predetermined pressure. The air liquid mixture exits nozzles in mist form that has small liquid droplets forming a fine mist which is propelled outward from the nozzle. In alternate embodiments, liquid flowing through the system that does not initially exit through the nozzles can be recirculated through the system by a return line that allows the non-sprayed mist liquid to flow back through the system and be recycled.

22 Claims, 5 Drawing Sheets

LIQUID SPRAYING SYSTEM FOR FINE MISTING AND HUMIDIFICATION

CROSS-REFERENCE TO RELATED APPLICATION

This application claims the benefit of U.S. Provisional Application Ser. No. 60/049,814, filed Jun. 17, 1997, and U.S. Provisional Application No. 60/083,603, filed Apr. 30, 1998.

BACKGROUND OF THE INVENTION

1. Field of the Invention

The present invention relates generally to the field of liquid misting or spraying systems, and more particularly to the field of automatic liquid misting systems having a variety of uses including the application of a fine water mist to food products in display counters, cooling of people at outdoor events, cooling of livestock, and humidification of green houses, warehouses, production facilities, and storage rooms.

2. Description of the Related Art

As the invention relates to the application of a fine mist to food produces, in order to maintain a fresh and desirable appearance of produce foods in a grocery store, certain produce must be kept sufficiently moist and cool. Otherwise, the produce will dehydrate, resulting in a reduced shelf life and an unattractive appearance giving reduced salability. The amount of moisture typically used to maintain proper hydration must be carefully controlled or else the quality of the produce can be adversely affected. It has long been the custom to spray the produce with a fine mist to retain the moisture in the produce and prevent drying of the produce. Earlier forms of spraying of produce took the form of a spray hose that was utilized manually to spray the produce on a counter. It has now become well known to utilize a permanent spraying system installed in a produce case with the spraying system including a plurality of nozzles spaced along the case, and usually including a time clock or the like to provide automatic misting of the produce.

Although, there are many existing systems that create mist and/or humidify the air, numerous problems or disadvantages are apparent throughout the known systems. Many systems have the problem of relatively large water droplets spraying from the heads of the nozzles, and such large droplets are a nuisance for shoppers and get products overly wet, or do not evaporate fast enough in evaporative cooling operations. Of the systems that attempt to minimize the large droplets, most create a very fine mist using high water pressure. In other systems, air and water are separately injected through separate ports into the same nozzle where they are expelled together to obtain a fine mist output. Other prior art systems make use of discriminators to create fine mists. Discriminators are mounted at the nozzle of spraying systems and deflect the liquid flowing out of the nozzle to create a fine mist consisting of smaller water droplets. However, a large percentage of the liquid does not spray outwardly into a mist over the food, flowers (or other products), but rather, strikes the discriminator and is partially deflected and wasted as the water falls in the form of a liquid stream or as large droplets. It would thus be a value to the industry to improve upon each of these prior systems.

SUMMARY OF THE INVENTION

Briefly described, the present invention comprises a liquid spraying system, including method and related apparatus for emitting a very fine mist. In accordance with the method of the present invention, air and liquid are purposely mixed in a conduit upstream of a nozzle and the "mixture" is then directed to and expelled from the nozzle. An appropriate introduction of air into the system provides for an appropriately uniform flow and a very fine mist of liquid flowing from the nozzle. Liquid is preferably introduced at the beginning of the system as tap water, such as supplied from a community water supply, where such supply usually provides sufficient pressure for the present purposes and is at an acceptable temperature. The liquid then passes through a feed line leading to a nozzle. Air is introduced into the system at a point on the feed line and prior to the nozzle.

In preferred embodiments of the apparatus of the present invention, the liquid spraying system includes: a feed line delivering liquid from a liquid supply to a disbursement assembly; a pump associated with the feed line to create an increased pressure differential on the feed line; an air introducing assembly through which air is introduced into the feed line; and a plurality of nozzle assemblies associated with the disbursement assembly from which the air and liquid mixture entering the disbursement assembly from the feed line is expelled into the environment.

In a first preferred embodiment of the present invention, the air introduction system introduces air into a shunt line which is tapped into the main feed line such that air already mixed with water is introduced to the feed line. In second and third preferred embodiments, the air introduction assembly introduces air directly into the feed line such that the first mixture of air and water is accomplished within the feed line.

In the preferred embodiments, a venturi system is utilized to introduce air into the system. Such a system operates on the principle of having a pressure difference between the inlet and outlet of a venturi injector to create a vacuum inside the body of the injector resulting in suction through a suction port in the injector. The suction is used to inject air into the system, thereby, mixing air with the liquid flowing through the system. Although, other methods of introducing air into the system may be used, such as an air compressor, the venturi system is preferred. A venturi system has no moving parts, thus requiring less maintenance than, for example, the compressor. The venturi system is located along the water line either before the pump or between the pump and the nozzle.

In a first, exemplary embodiment, representing the mentioned shunt-mounted air introduction assembly, water flows into the system through a main feed line to a connecting pump which pumps the water back into the feed line. The water is pumped out at a higher pressure and flows to a two line juncture in the feed line from which a portion of the water flows through a disbursement assembly having one or more nozzles connected thereto for displacement and misting, and the other portion of water flows through an air input line (the "shunt line") back into the feed line, upstream of the pump. Preferably, the pump flow rate is larger than the combined flow rate of all nozzles associated with the disbursement assembly, thus effecting a flow of the excess volume into and through the air input line. The portion of water flowing through the air input line flows through a venturi system connected to the air input line. Air is initially introduced to the water of the system as it flows through the venturi in this air input line (shunt line). The air/water mixture exiting the venturi flows to a juncture in the feed line downstream of the pump, where the air/water mixture combines with water entering the system and then flows back through the feed line to the pump where the cycle starts over again. This is a continuous cycle and, in this way, air is continuously added to an already existing mixture of air and water, thus increasing the air content. Furthermore, in this way, an air and water mixture enters the disbursement assembly for eventual introduction to and expulsion from the nozzles.

In a second, exemplary embodiment, the venturi is mounted directly in the feed line in a series-type arrangement such that air is initially introduced to the water of the system by introducing the air, through the venturi, directly into the feed line. The mixture of air and water flows out of the venturi system to a pump which pumps the mixture at a pre-determined pressure out through a disbursement assembly having one or more nozzles associated therewith for displacement and misting. Preferably, the disbursement assembly associated with this second, exemplary embodiment will expel a portion of the air/water mixture through the nozzle(s) of the assembly and will expel the remaining portion of the air/water mixture through either a return line (returning to the feed line downstream of the air introduction assembly and the pump) or a discharge line.

In a third, exemplary embodiment, the venturi is again mounted directly in the feed line in a series-type arrangement (similar to the previously mentioned second embodiment) and the mixture of air and water flows out of the venturi system to a pump which pumps the mixture at a pre-determined pressure out through a disbursement assembly having one or more nozzles associated therewith for displacement and misting. In accordance with this embodiment, an expansion tank is connected to the feed line (or the disbursement line) between the pump and the nozzles. This expansion tank has multiple roles: (i) it prevents the pump from repeatedly (and excessively) turning on and off, especially if the pump's flow rate is higher than the combined flow rate of the nozzles (e.g. it serves as a damper); (ii) it serves to accumulate air/water mixture at a predetermined pressure, for example, in situations where the liquid spraying system sprays for a short period of time and then is "off" for an extended period of time; and (iii) in association with its accumulation function, the expansion tank provides an immediate source of air/water mixture under required pressure when spray is requested (rather than suffering a delay waiting for the pump to build up pressure). Preferably, the disbursement assembly associated with this third exemplary embodiment does not have nor require a return or discharge line.

A plurality of alternate disbursement assemblies are acceptably used as the disbursement assembly of the liquid spraying system embodiments of the present invention. The disbursement assemblies comprise one or more disbursement lines to which are attached one or more nozzles from which the air/water mixture is expelled. Preferably, the disbursement assembly comprises a rather simplistic combination of a single, elongated disbursement line of rigid plastic into which are drilled a plurality of spaced apart apertures, into which are threaded nozzle assemblies, including a threaded stem and a nozzle head. These nozzles are oriented in any orientation within the 360° vertical plane and the 360° horizontal plane.

In an alternate disbursement assembly, a plurality of disbursement lines arranged in parallel flow relationship distribute the air/water mixture from the feed line to a plurality of fluid chambers—preferably one fluid chamber being associated with each disbursement line. The inside diameter of each of the fluid chambers is larger than the inside diameter of any attached return or discharge line, whereby the air/water mixture is caused to accumulate in the larger diameter fluid chambers, trapping air bubbles in the chambers. A portion of the air and water in each of the chambers is forced to move together into the nozzle assembly and through the nozzle assembly to escape the nozzle heads in the form of a very fine mist. Each fluid chamber and nozzle assembly combination of this alternate disbursement assembly is preferably oriented such that the communication path between the chamber and the nozzle outlet includes a vertical component such that trapped air bubbles can rise upward toward the direction of the nozzle outlet.

In each of the embodiments of the present invention, the nozzles (nozzle heads) are preferably made of plastic, although the use of metal nozzle heads is within the scope of the present invention.

Other features, objects and advantages of the present invention will become apparent upon reading and understanding this specification with reference to the accompanying drawings.

DETAILED DESCRIPTION OF THE PREFERRED EMBODIMENTS

Figure 1:
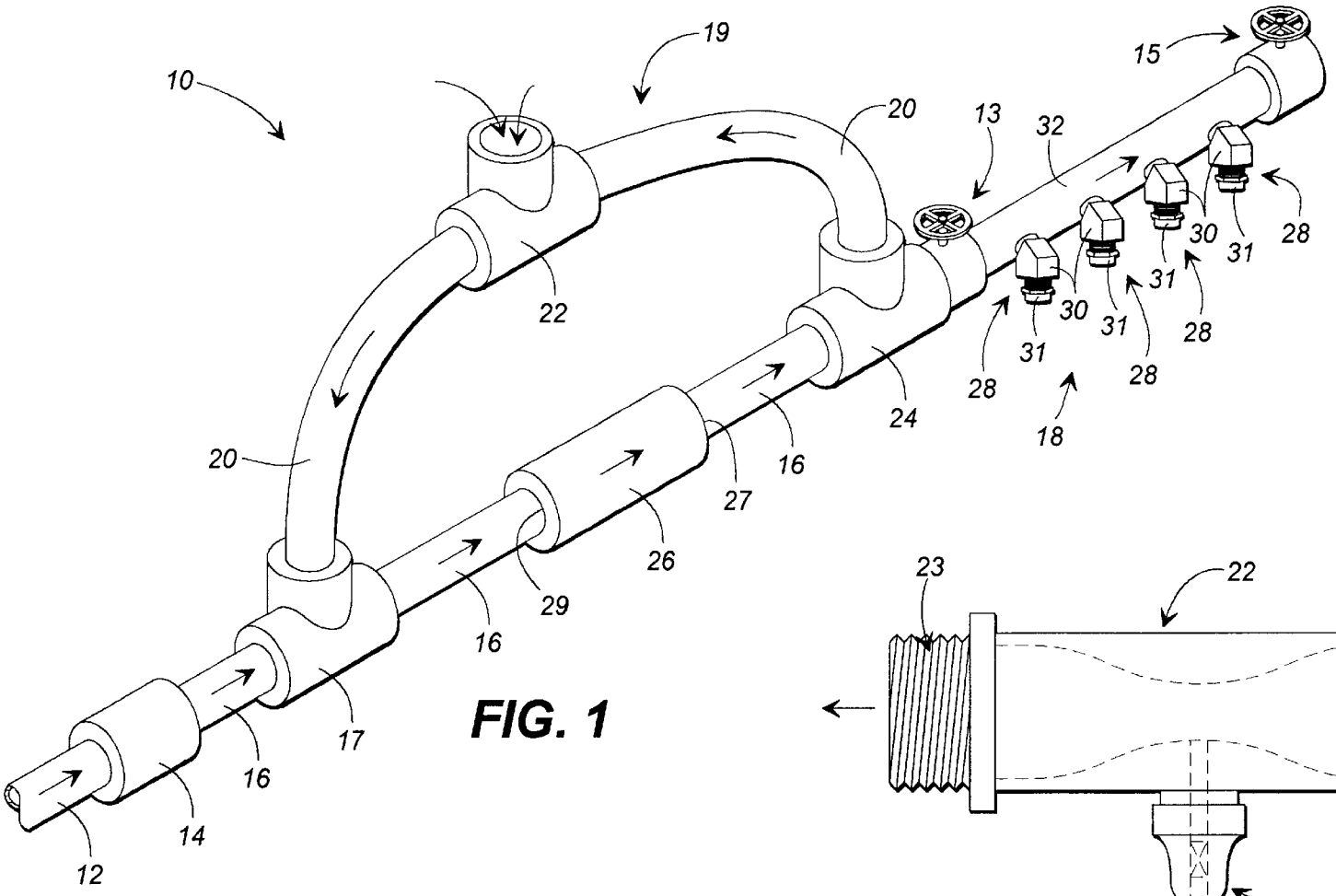
FIG. 1 is a perspective view of the liquid spraying system of the present invention, in accordance with a first, preferred embodiment.

Referring now more particularly to the drawings in which like numerals represent like components throughout the several views, and to those exemplary embodiments of the invention here represented by way of illustration, FIG. 1 depicts an exemplary embodiment of a first preferred embodiment of the liquid spraying system 10 of the present invention. The liquid spraying system 10 embodiment of FIG. 1 is seen as comprising a feed line 16 to which is operatively connected a pump 26, a disbursement assembly 18, and an air injection assembly 19. The feed line 16 connects the liquid spraying system 10 by an inlet port 14 (and, alternately, a pressure regulator) to a supply line 12 which supplies liquid from a liquid supply (not shown). The preferred liquid distributed by the present invention is water and, therefore, throughout the specification water will be referred to and should be understood as representing other possible liquids to be disbursed by the present invention. The air injection assembly 19 of this first preferred embodiment includes a venturi injector 22 mounted in fluid communication with a shunt line 20 (also referred to herein as the air inlet line 20) which is tapped into the feed line 16 at connectors 17 and 24. A supply valve 13 is positioned in the feed line 16, downstream from the points at which the air injection assembly 19 is tapped into the feed line. The supply valve 13 is preferably, not necessarily, solenoid operated. The disbursement assembly 18 is seen connected after the supply valve 13 in fluid communication with the feed line 16.

Figure 3:
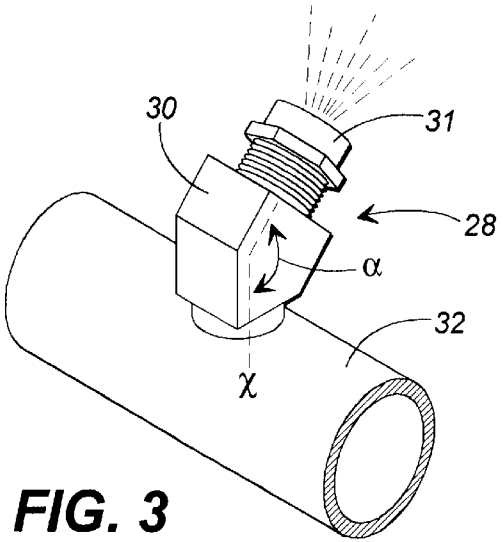
FIG. 3 is a perspective view of a single nozzle mounted on a section of a distribution conduit.

Whereas, a variety of disbursement assemblies 18 are acceptably utilized as the disbursement assembly of the liquid spraying system 10 of the present invention, a preferred disbursement assembly for utilization with this first preferred embodiment of FIG. 1 is seen as comprising a single disbursement line 32 extending from the connector 24 and to which is attached a plurality of nozzle assemblies 28. Though soft tubing is acceptable, the preferred embodiment utilizes as the disbursement line 32 a single, elongated, rigid plastic tubing into which are drilled at desired intervals a plurality of apertures (not seen), and a nozzle assembly 28 is threaded into each of the apertures. Whereas, nozzle assemblies 28 with a plurality of nozzles 31 (also sometimes referred as nozzle heads or sprayheads 31) are acceptably utilized here, the depicted embodiment of FIG. 1 shows single nozzles 31(single sprayheads 31) connected to a nozzle fitting 30, which nozzle fitting is threaded into the disbursement line aperture (See also FIG. 3). The nozzle fitting 30 is acceptably metal or plastic, preferably a metal such as brass or stainless steel; the nozzle 31 is acceptably metal or plastic, but preferably plastic it being one of the particular advantages of the present invention that the plastic nozzle 31 (sprayhead) is acceptably used in this system which sprays a combination of air and water. Though nozzles 31 of various acceptable types will give varying ranges of acceptable mist droplet sizes, the preferred nozzle 31 type is that which sprays in a conical spray pattern. One example of an acceptable nozzle 31, is a nozzle characterized by an 80-degree conical spray pattern, which, when spraying water, sprays at a rate of 0.4 gallons per hour or higher, depending upon water pressure. A nozzle of this type and characterization is available through Tefen Plastic Products Mfg. of Nahsholim, Israel, model number 0.4–80. In this embodiment of FIG. 1, a bleed valve 15 is positioned in the disbursement line 32, downstream from all of the nozzle assemblies 28. The bleed valve 15 is preferably, not necessarily, solenoid operated.

In the embodiment described in FIG. 1, liquid is provided by a conventional tap water system from which water flows into an inlet port 14 (or pressure regulator) of the feed line 16 for the system 10. The pump 26 moves the water through the feed line toward the downstream (relative to the flow in the feed line 16) connector 24. The preferred pump 26 is one that is characterized by an ability to effectively and continuously pump a mixture of gas and liquid. An example of a pump acceptable for the purpose of the present invention is a Rotary Vane pump. Diaphragm pumps have also been shown to provide good results in pumping air/water mixtures.

Figure 2:
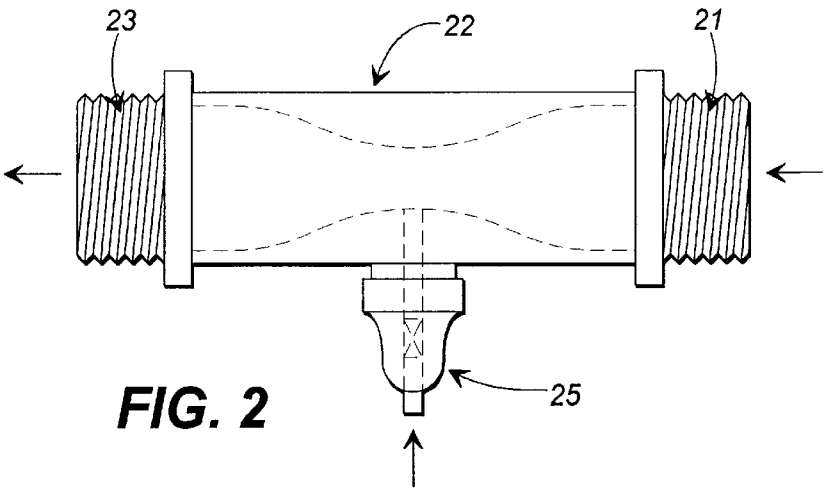
FIG. 2 is a front view of a venturi injector utilized in the exemplary embodiment hereof.

The downstream connector 24 allows a portion of the water to flow to the connecting air input line 20 and the rest to flow to the connecting disbursement line 32. A venturi injector 22 is mounted on air input line 20. As better seen in FIG. 2, the venturi injector 22 includes an inlet 21 which connects to the air input line 20, and receives the incoming flow of water from the air input line 20. The venturi injector 22 operates under the conditions where a pressure difference exists between the inlet 21 and the outlet 23 of the injector 22, a vacuum is created inside the body of the injector 22, which results is suction of air through the suction port 25. Examples of acceptable venturi injectors are those made by Mazzei Injector Corporation of Bakersfield, Calif., having models 287 and 384. As water flows through line 20 and through the injector 22, ambient air is pulled into the injector and mixed with the water flowing through the injector 22. This mixture of air and liquid exits the injector 22 and flows to the upstream (relative to the flow in the feed line 16) connector 17. At the upstream connector 17, the air/water mixture combines with water entering the system from feed line 16 and then flows through feed line 16 to pump 26. The air/water mixture pumped from pump 26 flows to the downstream connector 24. A portion of the air/water mixture then flows back through the air input line 20 again to repeat the cycle. The other portion of the air/water mixture flows from connector 24 to disbursement line 32. The air/water mixture that enters disbursement line 32 flows into and out of one or more nozzle assemblies 28 operatively mounted to disbursement line 32. The water exiting the nozzles 31 exits in the form of a very fine mist. Whereas other orientations of the nozzle 31 are within the scope of the invention, in the exemplary embodiment of FIG. 3, each nozzle 31 is, preferably, mounted to the fitting 30 at a 135 degree angle (see angle I of FIG. 3), and, thus, it can be adjusted in a 360 degree range about axis "X".

In the preferred operation, the supply valve 13 and bleed valve 15 are normally closed. With the supply valve 13 closed, system 10 will initiate circulation of water from the feed line 16 into and through the air injection assembly 19, thus through the venturi injector 22, to introduce air to the water supply thus initiating creation of the air/water mixture in the system. Likewise, the system will continually recirculate the air/water mixture through the air injection assembly 19, increasing the air content of the air/water mixture. After the air/water mixture has recirculated a plurality of times, and when it is desired to spray the space which is to be sprayed with the very fine mist, the supply valve 13 is opened, thus introducing the air/water mixture to the disbursement assembly 18, and the air/water mixture is expelled from the nozzles 31. The system will operate with the supply valve 13 open and the bleed valve 15 closed for a desired amount of time, referred to as the "spray cycle". At the end of a spray cycle, the bleed valve 15 is momentarily opened while the supply valve 13 is momentarily closed; then valve 15 returns to its normally closed condition while valve 13 remains closed. This momentary opening of the bleed valve 15 and closing of the supply valve 13 helps to release pressure in the disbursement of assembly 18 after a spray cycle has completed, thereby preventing dripping of the sprayheads 31.

Figure 4:
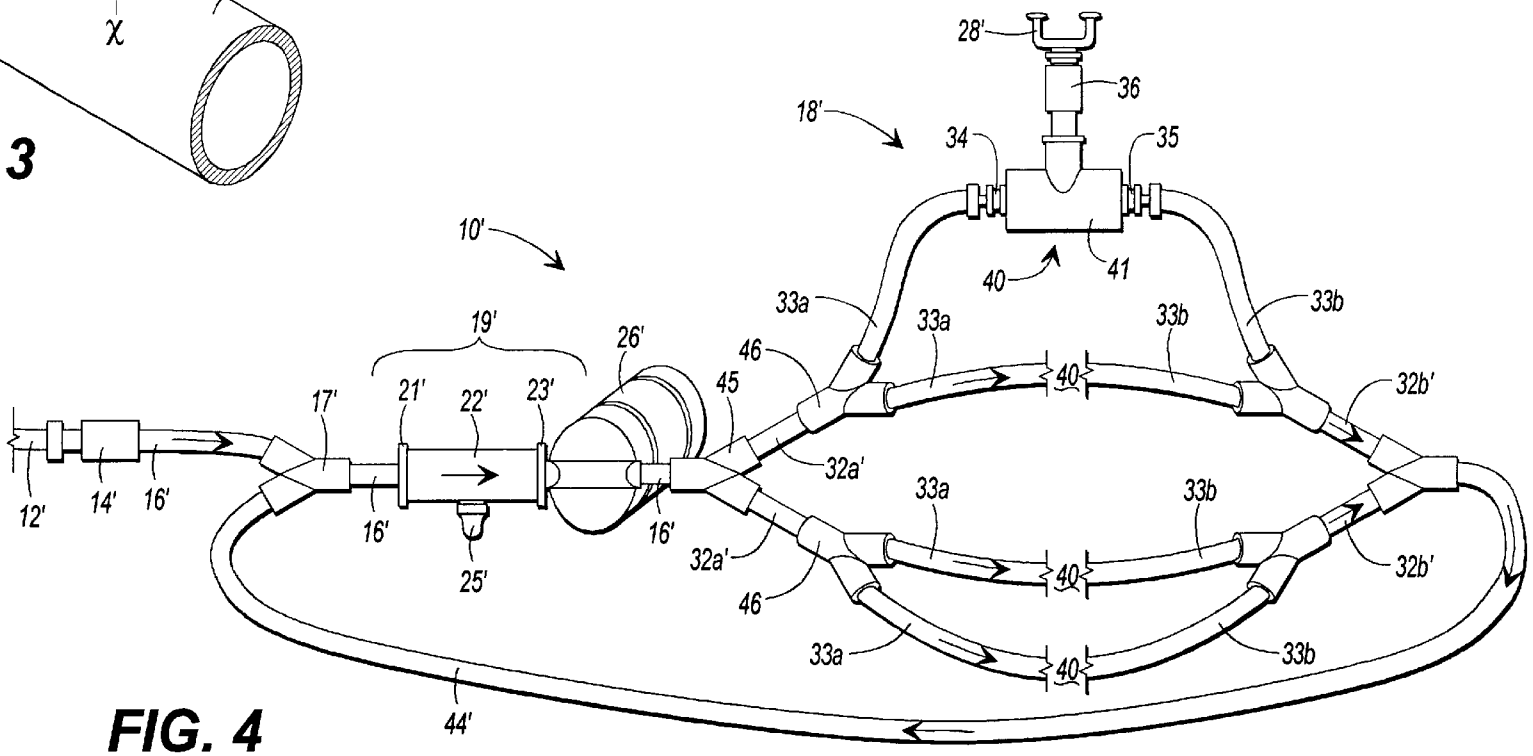
FIG. 4 is a perspective view of a second embodiment of a liquid spraying system of the present invention.
Figure 5:
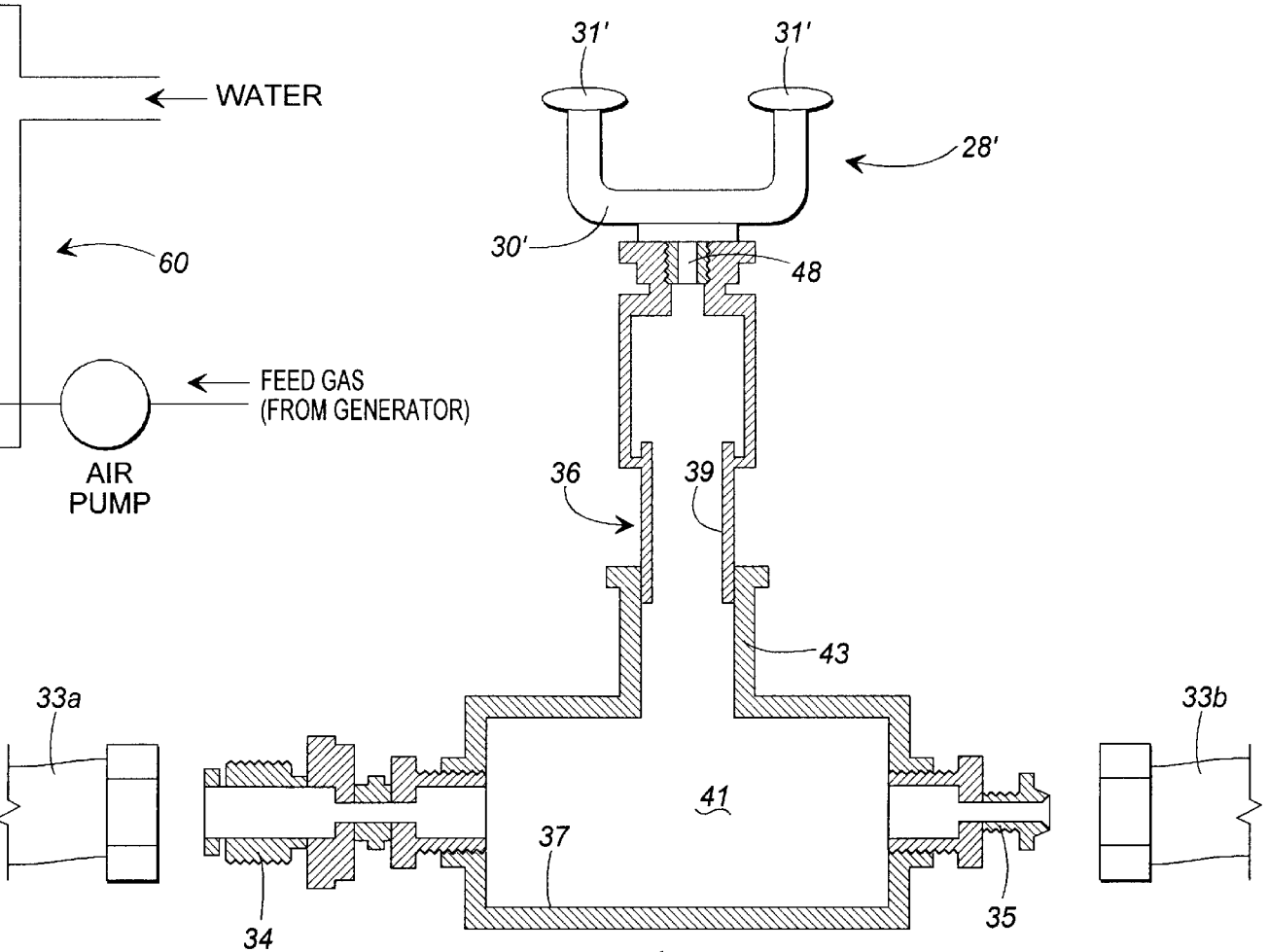
FIG. 5 is a partial cross-sectional view of fluid chamber having a spray station connected thereto.

With reference to FIG. 4, a second preferred embodiment of the liquid spraying system 10' of the present invention is seen as comprising a feed line 16' to which is operatively connected an air injection assembly 19', a pump 26' and a disbursement assembly 18'. The feed line 16' connects the liquid spraying system 10' by an inlet port 14' (or pressure regulator) to a supply line 12' which supplies liquid from a liquid supply (not shown). The air injection assembly 19' of this second preferred embodiment includes a venturi injector 22' mounted in fluid communication with the feed line 16'. Operatively mounted downstream on the feed line 16' from the venturi injector 22' is a pump 26'. The disbursement assembly 18' is seen connected at connector 45 in fluid communication with the feed line 16', downstream from the pump 26'. Whereas, a variety of disbursement assemblies, are acceptably utilized as the disbursement assembly of the liquid spraying system 10' of the present invention, a preferred disbursement assembly 18 for utilization with this second preferred embodiment of FIG. 4 is seen as comprising a plurality of disbursement lines 32*a*' extending from a connector 45 and sub-disbursement lines 33 extending from connectors 46 and to which is attached to each sub-disbursement line a fluid chamber 40. The fluid chambers 40 are connected in parallel along the sub-disbursement lines 33. As seen in FIG. 5, each fluid chamber 40 includes a lower portion 41 having line inlet and line outlet ports 34 and 35, an upper outlet 43 and an upper portion 36.

Each of the sub-disbursements lines 33 is depicted as having a first segment 31*a* connected to the inlet port 34 of a fluid chamber lower portion 41 and a second segments 33*b* connected to the outlet port 35 of the lower portion 41. Each lower portion 41 (see FIG. 5) defines a fluid passage 37 in communication with the inlet port 34 and, thus, the first sub-disbursement line segment 33*a* and in communication with the outlet port 35 and thus the sub-disbursement line second segment 33*b*. The upper portion 36 of each fluid chamber 40 defines a fluid passage 39.

The inside diameter of the lower portion 41 is larger than the inside diameters of the sub-disbursement lines 33 connecting the inlet and outlet ports 34 and 35. Attached to each fluid chamber 40 is a dual nozzle assembly 28'. The preferred embodiment utilizes a plurality of soft tubings which connect to the inlet port 34 and outlet port 35 of each fluid chamber 40. Whereas, nozzle assemblies with more than two nozzle heads or only a single nozzle head are acceptably utilized here, the depicted embodiment of FIG. 4 shows dual nozzles 31' (dual sprayheads) connected to a nozzle fitting 30', which nozzle fitting is threaded into a fluid chamber 40. The nozzle fitting 30' is acceptably metal or plastic, preferably a metal such as brass or stainless steel; the nozzles 31' are acceptably metal or plastic, but preferably plastic—it being one of the particular advantages of the present invention that the plastic nozzles (sprayheads) are acceptably used in this system which sprays a combination of air and water. In the embodiment of FIG. 4 a return line 44 connects to the feed line 16' at a downstream connector 17'.

In operation, newly supplied water flows from the supply line 12, through feed line 16' to the downstream connector 17'. At the connector 17', water that has already flowed through the system, flows back to connector 17' through alternate return line 44. The combination of water entering the system from the inlet port 14' and returning from alternate return line 44 at connector 17', flows to a venturi injector 22 where air is injected into the flow of water. In this embodiment, a liquid pump 26' is connected to the conduit system, preferably along feed line 16' in series with the venturi injector 22'. Air is sucked into suction port 25' of the venturi injector 22' by the pressure difference existing in the venturi injector 22'. The air sucked into the suction port 25' is pulled into the flow of water flowing through the venturi injector 22'. This combination of air and water exits the venturi injector 22' at outlet 23 and is pulled into the liquid pump 26'. The liquid pump 26' pumps the liquid/air mixture out to one or more fluid chambers 40. In this alternate embodiment, there are a plurality of fluid chambers in parallel with each other along corresponding parallel sub-disbursement lines 33' connected to feed line 16' and adjacent liquid pump 26'. The water/air mixture enters the lower portions 41 of each fluid chamber 40 along a sub-disbursement line 33'. The difference between the inside diameters of the fluid passages 37 of the lower portions 41 and connecting sub-disbursement lines 33', allow for the trapping of air in the upper part of the chamber 40 and the escape of air with water through a dual nozzle assembly 28' to create very fine mist.

Preferably, in this embodiment of FIG. 4, the lower portion 41 is maintained in a horizontal position with each integral upper portion 36 extending upwardly between the angles of 0 and 180 degrees from horizontal. Therefore, the liquid misting system 10' will, preferably, extend along the base of a display case with the mist spraying upwardly and over onto the produce in the display case as opposed to being mounted above the display case and spraying downwardly onto the produce as in prior art and the first preferred embodiment. Without limiting its uses, this embodiment finds usefulness to create humidity in a room or large hall.

The majority of fluid passing through the fluid chambers 40 will continue through the lower portions 41 of the fluid chambers 40 to a connecting collection line 32*b*' and, eventually, to a return line 4. The return lines 44 direct the flow of liquid back into the feed line 16' at connecting point 17' between the liquid supply and the introduction of air along the feed line 16'.

Figure 6:
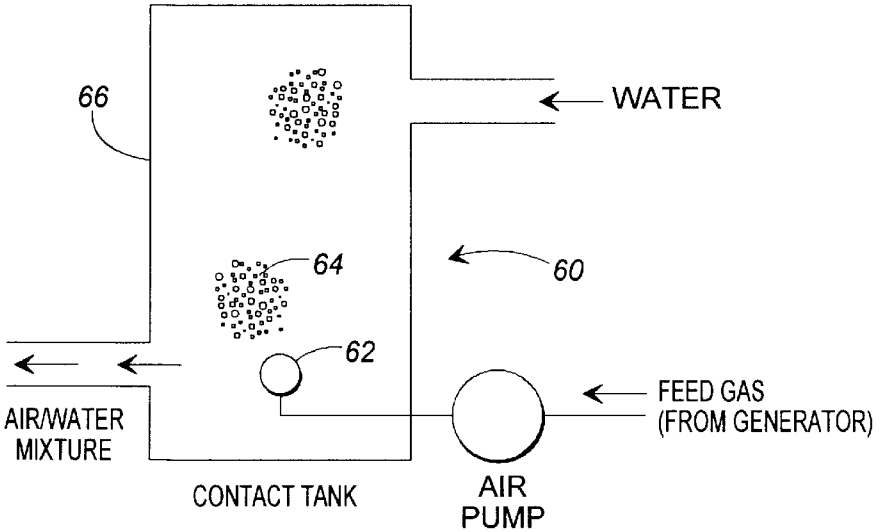
FIG. 6 is diagrammatic representation of a bubble diffuser useable in alternate embodiments of the present invention.

An alternate method of introducing air into either of the pre-mentioned embodiments involves the transfer of air via the use of a fine bubble diffuser 60, as depicted in FIG. 6. Fine bubble diffuser technology utilizes porous media, made of materials such as ceramic or metal 62, for the purpose of distributing micro-sized bubbles 64 into an column of water. Applying greater pressure to the air stream (typically 15 pounds per square inch—psi) than the pressure of the water column forces the air into the water through the porous device. The small bubbles then rise slowly up toward the top of the contact tank 66. This slow rise increases the contact time the air has with the water. The finer the bubble, the more effective the surface area is in contact with the water and the better the efficiency of mass transfer of gas to liquid. If this is achieved, then bubble size will increase, and therefore, mass transfer efficiency will decrease. This contact tank can be placed on the feed line in the place of the venturi to introduce air into the system.

Figure 7:
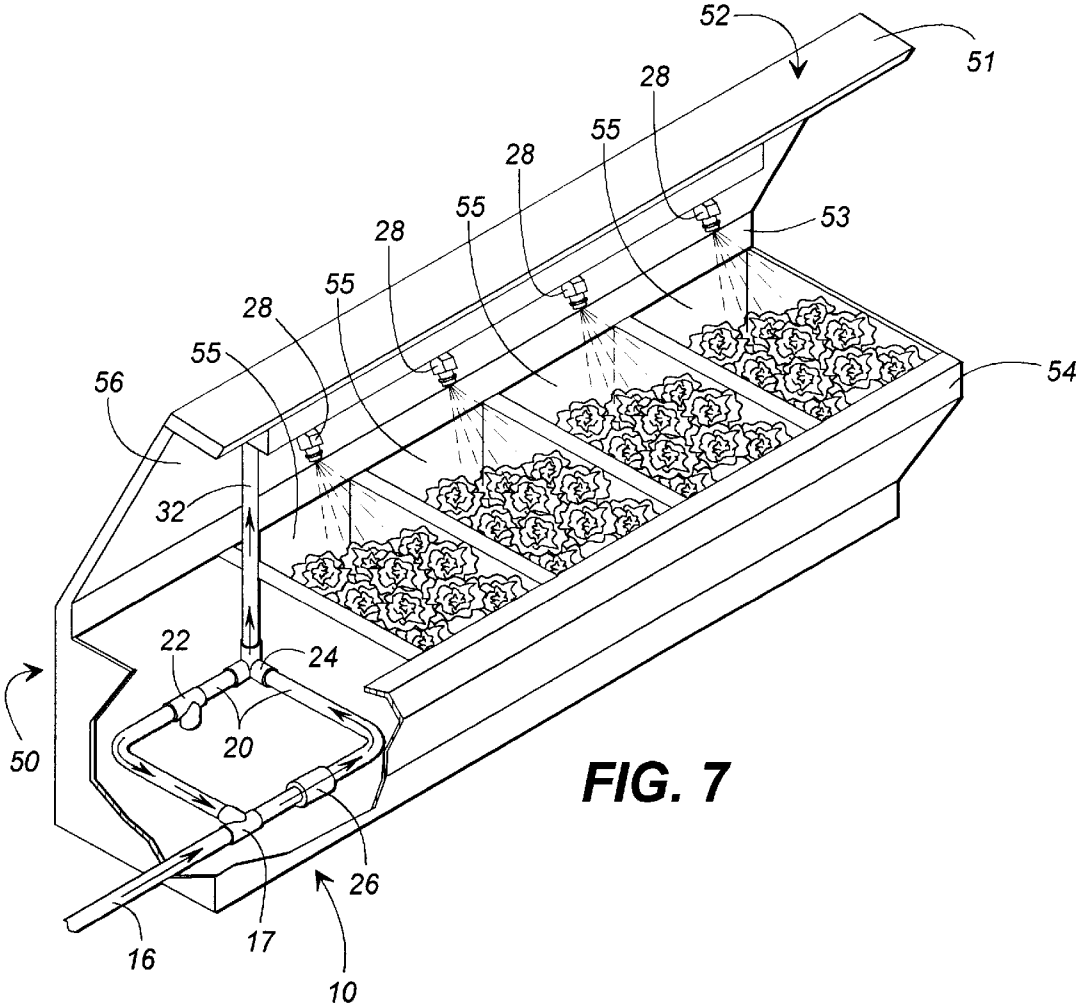
FIG. 7 is a front perspective view of a produce display case having mounted therein a liquid spraying system according to FIG. 1.

FIG. 7 depicts a combination, in accordance with the present invention, of the spraying system 10 mounted to a product display case 50. The product display case 50 shown in FIG. 7 is shown as a representation of a display case (refrigerated or non-refrigerated) having an opening accessible to the public and in which would typically be displayed food products. This case 50 shown in FIG. 7 is meant to simply represent the wide variety of display cases to which the liquid spraying system 10 of the present invention is acceptably mounted in combination to define an integrated case and spray system combination in accordance with the present invention. Such cases, without limitation, are of varying design and are used to display produce, meat products, flowers, and other products as it will be understood to those in the industry. In FIG. 7, the display case 50 includes a base 54 having a plurality of bins 55 for holding fresh produce therein. One or more apertures may exist in the base 54 for accommodating the feed line 16 connecting an outer water supply to the rest of the system contained within the display case. Extending from the base 54 of the display case 50 is an upper rear wall 56 and an attached canopy 52. The upper rear wall 56 may have a mirrored surface to make it easier to see the produce in the bins 55. The nozzle assemblies 28 are seen mounted at the top 51 of the canopy 52 of the display case 50, aiming down and backward. However, the nozzles are, alternately, mounted at the canopy base 53 aiming up and forward, or at a number of other different locations in the display case. Whereas, the spraying system depicted in the combination of FIG. 7 is seen as that of the embodiment of FIG. 1, it is understood that other embodiments of the spray system are acceptably utilized in the combination.

Figure 8:
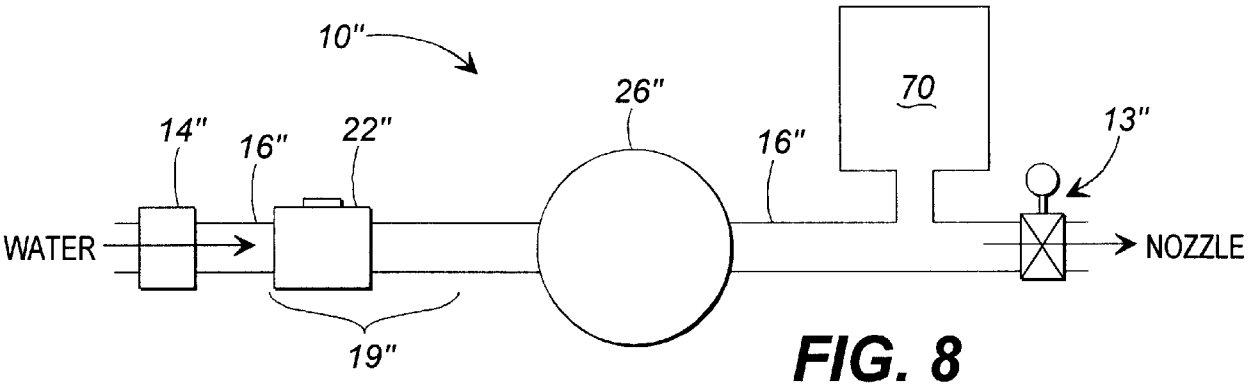
FIG. 8 is a diagrammatic representation of a third embodiment of the liquid spraying system.

FIG. 8 illustrates a third, preferred embodiment of the spraying system 10 having a venturi injector 22" on the feed line 16 which then is pulled into and through pump 28. Pump 28 preferably operates in a range of 50–150 psi, and includes an internal pressure switch and an internal check valve. The air injection assembly 19", feed line 16" and pump 26" of this embodiment are structurally and functionally similar to that described in connection with the embodiment of FIG. 4. In accordance with this embodiment, an expansion tank 70 is located connected to the feed line 16" between the pump 26" and the supply valve 13"(leading to the disbursement assembly, not shown). The expansion tank 70 is connected to the feed line 16" in a manner such that when the supply valve 13" is closed, air/water mixture from the feed line is directed to the expansion tank for storage to be immediately available when the supply valve is open. Furthermore, when the supply valve 13" is open and air/water mixture is flowing to the disbursement assembly, the expansion tank acts to accumulate excess air/water when the flow exceeds the outlet capacity of the nozzles of the disbursement assembly; in this way, the expansion tank acts as a buffer assisting in smooth operation of the pump and the distribution nozzles during the spray cycles of the system. Preferably, the disbursement assembly 18 utilized in this third embodiment is of the closed-end type (no return line) mentioned in connection with the first embodiment of FIG. 1 above. In this third embodiment, the nozzle assemblies 28 are acceptably single sprayhead and/or multiple sprayhead types and the sprayheads function acceptably in any orientation. (See, for example, the single sprayhead nozzle assembly 28 of FIG. 3 as well as the multiple sprayhead nozzle assembly 28' of FIG. 5. The multiple assembly of FIG. 5 would, in this embodiment, be preferably mounted to a nozzle fitting 30 such as that seen in FIG. 3).

Figure 9:
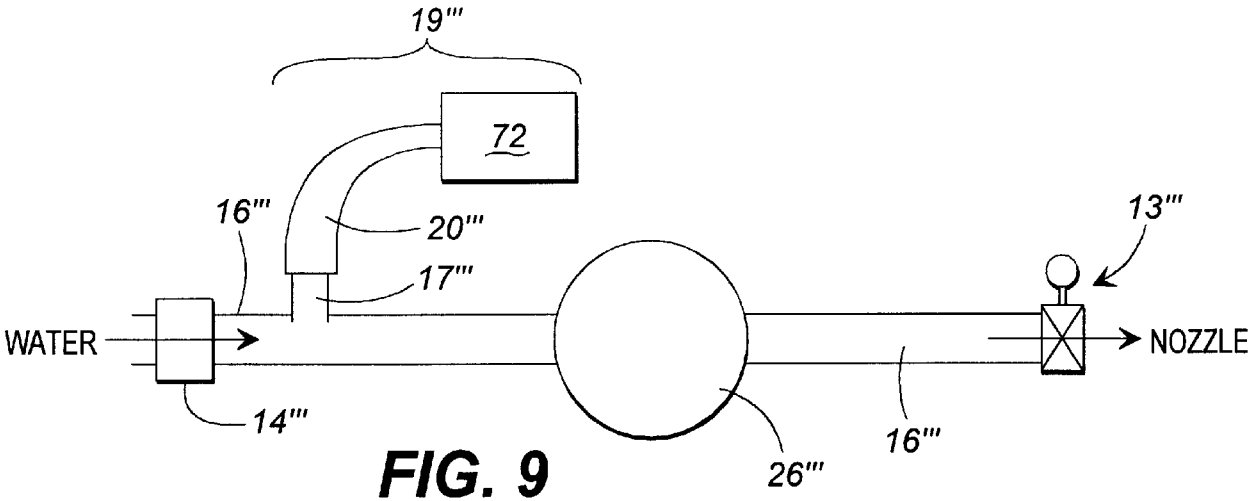
FIG. 9 is a diagramatic representation of a fourth embodiment of the liquid spraying system.

FIG. 9 illustrates a fourth, preferred embodiment of the spraying system 10'" utilizing as the air injection assembly 19'" an air compressor 72 connected by a shunt line 20'" to an upstream connector 17'" by which air is introduced to the feed line 16'", preferably (though not necessarily) upstream from a pump 26'". The air/water mixture is distributed, as will be understood by reference to the previous embodiments, through the supply valve 13'" to an appropriate disbursement assembly.

Whereas this invention has been described in detail with particular reference its most preferred embodiment, it will be understood that variations and modifications can be effected within the spirit and scope of the invention, as described herein before and as defined in the appended claims. In addition, the corresponding structures, materials, acts, and equivalents of all means or step plus function elements in the claims are intended to include any structure, material, or act for performing the functions in combination with other claimed elements, as specifically claimed herein.

I claim:

1. A liquid spraying system for delivering a fine misted spray of liquid to an environment, said system comprising:

a conduit assembly defining a liquid passage;

means for supplying liquid to said liquid passage;

means for introducing air to said liquid passage, whereby water and air combine to form an air-liquid mixture within said liquid passage;

a pump operatively connected to said conduit assembly, whereby movement of the air-liquid mixture through said passage is assisted; and a nozzle assembly connected to said conduit assembly for expelling said air-liquid mixture, wherein said means for introducing air introduces air before the said pump, whereby the air-liquid mixture flows into said pump and to said nozzle assembly.

2. A liquid spraying system as in claim 1, wherein said means for introducing air into said system is through a venturi injector.

3. The liquid spraying system as in claim 1, further comprising an expansion tank in communication with said conduit assembly after said pump and before said nozzle assembly.

4. The liquid spraying system as in claim 1, wherein, said means for introducing air into said system is through an air compressor.

5. A liquid spraying system for delivering a fine misted spray of a liquid to an environment, said system comprising:

a conduit assembly defining a liquid passage;

means for supplying liquid to said liquid passage;

means for introducing air to said liquid passage, whereby water and air combine to form an air-liquid mixture within said passage;

a nozzle assembly connected to said conduit assembly for expelling said air-water mixture, said nozzle assembly including a plurality of nozzles;

said conduit assembly including at least a feed line segment, an air input line segment, and a disbursement line segment;

said feed line segment comprising at least a second conduit member, said second conduit member having an inlet port and an outlet port, said second conduit inlet port connecting to said first conduit outlet port;

said air input line segment comprising at least a third conduit member, said third conduit member having an inlet port and an outlet port, said third conduit outlet port connecting to said second conduit inlet port;

said means for introducing air being located on said third conduit member;

said disbursement line segment having at least a forth conduit member, said forth conduit member having an inlet port and an outlet port, said forth conduit inlet port being connected to said second conduit outlet port; and said nozzle assembly being mounted to said forth conduit member.

6. The liquid spraying system as in claim 5, further comprising a pump operatively connected to said second conduit member.

7. The liquid spraying system as in claim 5, wherein said means for introducing air is a venturi injector.

8. The liquid spraying system as in claim 5, wherein said means for introducing air is an air compressor.

9. The liquid spraying system as in claim 5, wherein said means for introducing air is a bubble diffuser.

10. A liquid spraying system, comprising:

a liquid supply;

a feed line in fluid communication with said liquid supply, said feed line having an inlet end and an outlet end, said inlet end being in fluid communication with said liquid supply;

a pump in flow communication with said feed line, said pump having an inlet and an outlet, whereby said pump moves liquid out of said pump outlet at a predetermined pressure;

means for supplying air to said feed line, said means for supplying air being connected at a location between said feed line [between said feed line] inlet end and said means for pumping liquid;

a disbursement line having an inlet and outlet, said inlet being connected to said pump outlet, said outlet having an inside diameter;

at least one fluid chamber connected to said outlet of said disbursement line; said fluid chamber including, an in-line chamber portion having an inlet end, an outlet end, and an intermediate open portion;

an expanded chamber portion having an inlet end and an outlet end, said in-line chamber portion having an interior diameter larger than the inside diameter of said disbursement line outlet; and a nozzle assembly in flow communication with said expanded chamber outlet end.

11. The liquid spraying system as in claim 10, wherein said system includes a return line, said return line having an inlet end and outlet end, said return line inlet end being in communication with said outlet end of said in-line chamber portion, said return line inlet end having an interior diameter smaller than the interior diameter of said substantially horizontal chamber, said return line outlet end being in communication with said feed line at a location between said feed line inlet end and said means for supplying air.

12. The liquid spraying system as in claim 10, wherein said means for supplying air to said feed line is a venturi injector.

13. The liquid spraying system as in claim 10, wherein said pump is an electrical pressure pump.

14. A liquid spraying system for delivering a fine misted spray of liquid to an environment, said system comprising:

a conduit member defining a liquid passage, a liquid inlet to said passage and an air inlet to said passage, whereby liquid and air introduced into the respective inlets will be mixed and travel together as an air-liquid mixture through the passage;

a pump operatively connected to said conduit member, whereby movement of liquid through the conduit member is assisted; and a nozzle assembly connected to said conduit member, said liquid inlet and said air inlet of said conduit member being positioned upstream to both said pump and said nozzle, whereby liquid and air of the liquid and air mixture escape simultaneously from the nozzle.

15. A liquid spraying system for delivering a fine misted spray of liquid to an environment, said system comprising;

a conduit assembly including at least a feed line segment and a delivery segment, said feed line segment comprising at least a first conduit member, a liquid inlet port in communication with said first conduit member, and an outlet from said first conduit member;

said delivery segment comprising at least a second conduit member, an inlet port connected to said outlet of said first conduit member and in communication with said second conduit member, and an outlet from said second conduit member;

a pump connected to said feed line; and at least one fluid chamber member connected to said second conduit member, said chamber member defining an in-line chamber portion and an expanded chamber portion.

16. A method for applying a fine liquid mist on produce displayed in a produce display, said method including the steps of:

supplying liquid to a feed line through a liquid inlet;

introducing air to the liquid flowing through the feed line at a location in the feed line past the liquid inlet of said feed line;

pumping said air and liquid mixture to a plurality of nozzles; ejecting said air and liquid mixture from said plurality of nozzles; and directing liquid not ejected from said plurality of nozzles through a return line back into said feed line at a location in the feed line prior to when air is introduced into the feed line.

17. The method as in claim 16, wherein said introduction of air into the feed line is by a venturi system.

18. The method as in claim 16, wherein said introduction of air into the feed line is through an air compressor.

19. A method of spraying a fine mist of liquid, comprising the steps of:

continually introducing air into a water stream upstream from a pump;

directing the air laden water stream from a pump to an expansion tank;

directing the air laden water stream from the expansion tank to a nozzle; and selectively expelling the air and water combination from the nozzle.

20. The method as in claim 19, wherein the step of continually introducing air into a water stream is continually introducing air through a venturi injector in fluid communication with the water stream.

21. A liquid spraying system for delivering a fine misted spray of liquid to an environment, said system comprising:

a conduit assembly defining a liquid passage;

means for supplying liquid to said liquid passage;

means for introducing air to said liquid passage, whereby water and air combine to form an air-liquid mixture within said passage;

a pump operatively connected to said conduit assembly, whereby movement of the air-liquid mixture through said passage is assisted; and a nozzle assembly connected to said conduit assembly for expelling said air-liquid mixture; and an expansion tank in communication with said conduit assembly after said pump and before said nozzle assembly.

22. A liquid spraying system for delivering a fine misted spray of liquid to an environment, said system comprising:

a conduit member defining a liquid passage, a liquid inlet to said passage and an air inlet to said passage, whereby liquid and air introduced into the respective inlets will be mixed and travel together as an air-liquid mixture through the liquid passage;

a pump operatively connected to said conduit member, whereby movement of liquid through the conduit member is assisted;

a nozzle assembly connected to said conduit member, said liquid inlet and said air inlet of said conduit member each being positioned upstream to said nozzle assembly, whereby liquid and air of the liquid and air mixture escape simultaneously from the nozzle assembly; and a chamber assembly connected between said conduit member and said nozzle assembly, said chamber assembly comprising an in-line chamber portion and an expanded chamber portion, said in-line chamber portion defining a chamber having an inlet end and an outlet end, and an intermediate portion between said inlet end and said outlet end, and said expanded chamber portion defining a chamber having an inlet end and an outlet end, said inlet end connecting to said in-line chamber intermediate portion.

* * * * *